US010656551B1

(12) United States Patent
Sasaki

(10) Patent No.: US 10,656,551 B1
(45) Date of Patent: May 19, 2020

(54) IMAGE FORMING APPARATUS AND CONTROL METHOD OF IMAGE FORMING APPARATUS

(71) Applicant: TOSHIBA TEC KABUSHIKI KAISHA, Shinagawa-ku, Tokyo (JP)

(72) Inventor: Hidehito Sasaki, Ota Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/168,925

(22) Filed: Oct. 24, 2018

(51) Int. Cl.
*G03G 15/043* (2006.01)
*G03G 15/01* (2006.01)
*G03G 15/00* (2006.01)

(52) U.S. Cl.
CPC ..... *G03G 15/043* (2013.01); *G03G 15/0194* (2013.01); *G03G 15/5058* (2013.01); *G03G 2215/0141* (2013.01); *G03G 2215/0161* (2013.01)

(58) Field of Classification Search
CPC ..... G03G 15/043; G03G 15/0194; G03G 15/5058; G03G 2215/0141; G03G 2215/0161
See application file for complete search history.

(56) References Cited

U.S. PATENT DOCUMENTS

2012/0275811 A1 11/2012 Sasaki
2014/0240431 A1* 8/2014 Murayama ..... G03G 15/04054 347/118

* cited by examiner

*Primary Examiner* — David M. Gray
*Assistant Examiner* — Michael A Harrison
(74) *Attorney, Agent, or Firm* — Amin, Turocy & Watson LLP

(57) ABSTRACT

According to one embodiment, an image forming apparatus includes a plurality of process units, a transferring member, a sensor, and a processor. The plurality of process units include a photosensitive drum, an electric charger which charges the photosensitive drum, an exposing device which includes a plurality of light emitting element rows in a sub-scanning direction configured by the plurality of light emitting elements, and irradiates the photosensitive drum to form a latent image, and a developing device which attaches toner to the latent image to form a toner image. The transferring member receives the toner image from the photosensitive drum. The sensor detects the toner image transferred to the transferring member. The processor calculates a skew deviation amount based on the detection result of the sensor, and controls turning on and off the light emitting element based on a central tendency and the skew deviation amount.

16 Claims, 6 Drawing Sheets

IMAGE FORMING APPARATUS AND CONTROL METHOD OF IMAGE FORMING APPARATUS

FIELD

Embodiments described herein relate generally to an image forming apparatus and a control method of the image forming apparatus.

BACKGROUND

An image forming apparatus includes a plurality of process units which include a photosensitive drum, an electric charger, an exposing device, a developing device, and a transferring member. The electric charger charges the photosensitive drum. The exposing device emits light to the charged photosensitive drum to form a latent image based on image data. The developing device attaches toner to the latent image of the photosensitive drum to form a toner image. The transferring member transfers the toner image formed in the photosensitive drum to a print medium.

Positions of the toner images which are transferred from the plurality of process units to the transferring member and correspond to a certain point of the image data may be not matched on the transferring member. This is because there is generated a difference in slope of a region where the photosensitive drum and the transferring member abut on between the plurality of processing units, or a difference in slope of a region where the photosensitive drum is emitted with the light from the exposing device due to an attachment tolerance of the configuration of the plurality of process units.

Therefore, there is an image forming apparatus which includes an exposing device. The exposing device includes a plurality of light emitting element rows in a sub-scanning direction where a plurality of light emitting elements are arranged in a main scanning direction. The image forming apparatus corrects a difference in slope of each process unit by selecting a light emitting element to be turned on among the light emitting elements aligned in the sub-scanning direction. For example, if the image forming apparatus is configured to perform printing with four colors CMYK, the image forming apparatus selects a light emitting element to be turned on among the light emitting elements aligned in the sub-scanning direction in accordance with the position of the toner image of K color.

However, in the above method, the place where the light emitting element rows are switched is printed with a difference due to a resolution. As the place where the light emitting element rows are switched is increased, the number of differences is increased, and thus an image quality is degraded. In particular, if there is even one color causing a large difference, good image quality cannot be obtained.

DETAILED DESCRIPTION

In general, according to one embodiment, an image forming apparatus includes a plurality of process units, a transferring member, a sensor, and a processor. The plurality of process units include a photosensitive drum, an electric charger which charges the photosensitive drum, an exposing device which includes a plurality of light emitting element rows in a sub-scanning direction configured by the plurality of light emitting elements disposed in a main scanning direction, and irradiates the photosensitive drum to forma latent image while switching the light emitting element rows, and a developing device which attaches toner to the latent image of the photosensitive drum to form a toner image. The transferring member receives the toner image from the photosensitive drum of each process unit, and transfers the toner image to a print medium. The sensor detects the toner image transferred from the photosensitive drum of each process unit to the transferring member. The processor calculates a skew deviation amount of each process unit based on the detection result of the sensor, and controls turning on and off the light emitting element of each exposing device based on a central tendency of the calculated skew deviation amount and the skew deviation amount of each process unit.

Figure 1:
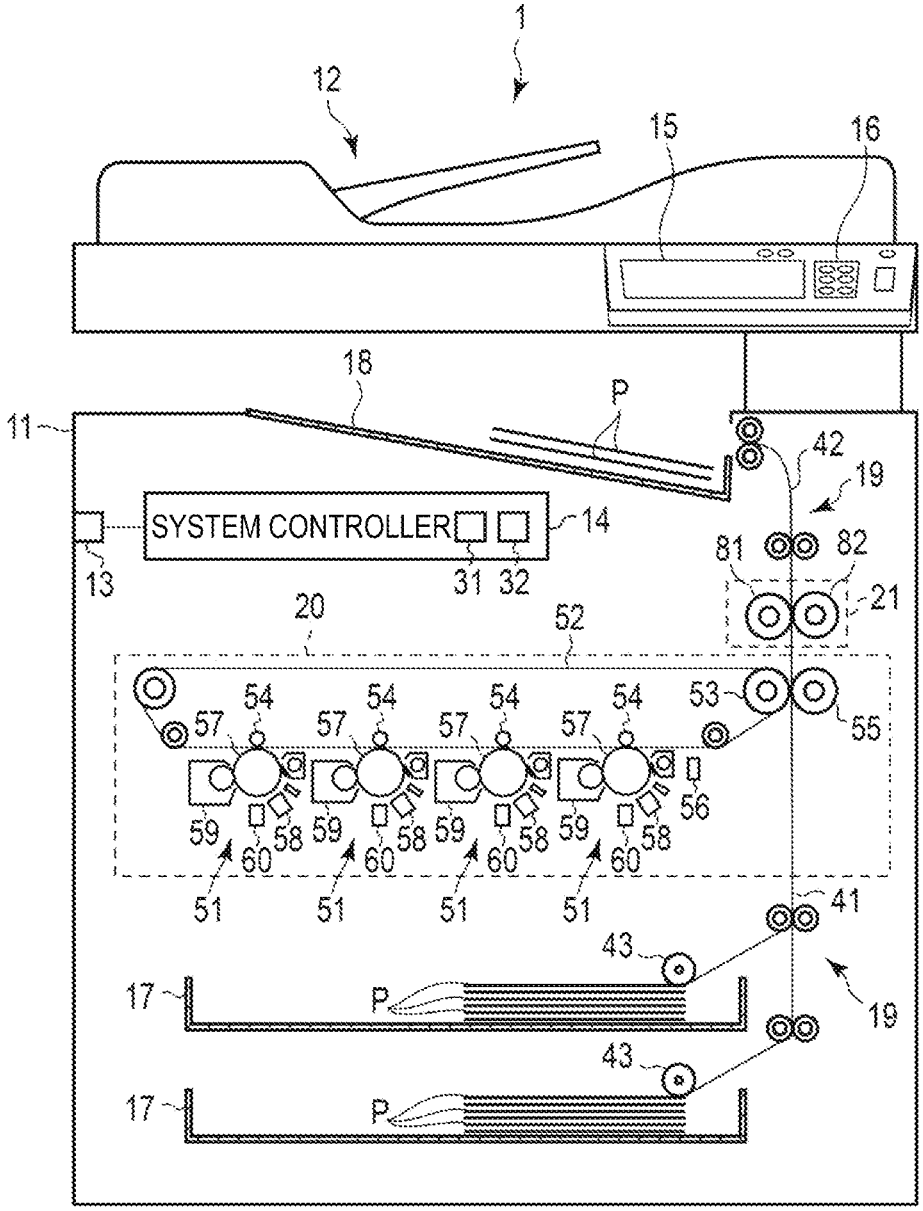
FIG. 1 is a diagram for describing an exemplary configuration of an image forming apparatus according to an embodiment.

Hereinbelow, the image forming apparatus according to an embodiment and a controlling method of the image forming apparatus will be described with reference to the drawings. FIG. 1 is an explanatory diagram for describing an exemplary configuration of an image forming apparatus 1 according to an embodiment.

The image forming apparatus 1 is, for example, a multifunction printer (MFP) which performs various types of processes such as image formation while conveying a recording medium such as the print medium. The image forming apparatus 1 is, for example, a solid-scanning type of printer (for example, LED printer) which scans an LED array performing various types of processes such as image formation while conveying a recording medium such as the print medium.

For example, the image forming apparatus 1 is configured to form an image in the print medium using color toner. The color toner includes, for example, Cyan, Magenta, Yellow, and Black toner. The color toner is melt at a temperature equal to or more than a predetermined fixing temperature, and fixed. The fixing temperature is, for example, 180° C.

As illustrated in FIG. 1, the image forming apparatus includes a housing 11, an image reading unit 12, a communication interface 13, a system controller 14, a display unit 15, an operation interface 16, a plurality of paper trays 17, a paper discharge tray 18, a conveyance unit 19, an image forming section 20, and a fixing device 21.

The housing 11 is a main body of the image forming apparatus 1. The housing 11 contains the image reading unit 12, the communication interface 13, the system controller 14, the display unit 15, the operation interface 16, the plurality of paper trays 17, the paper discharge tray 18, the conveyance unit 19, the image forming section 20, and the fixing device 21.

The image reading unit 12 is configured to read an image from an original document. The image reading unit 12 includes a scanner for example. The scanner acquires the image of the original document according to the control of the system controller 14.

The communication interface 13 is an interface for the communication with other devices. The communication interface 13 is used for the communication with a host device (external device) for example. The communication interface 13 is configured as a LAN connector for example. In addition, the communication interface 13 may communicate with other devices in a wireless manner according to a standard such as Bluetooth (registered trademark) or Wi-fi (registered trademark).

The system controller 14 controls the image forming apparatus 1. The system controller 14 includes, for example, a processor 31 and a memory 32. In addition, the system controller 14 is connected to the image reading unit 12, the conveyance unit 19, the image forming section 20, and the fixing device 21 via a bus.

The processor 31 is a calculating element which performs a calculation process. The processor 31 is, for example, a CPU. The processor 31 performs various types of processes based on data of a program stored in the memory 32. The processor 31 serves as a control unit which can perform various types of operations by executing the program stored in the memory 32.

The memory 32 is a recording medium which stores a program and data to be used in the program. In addition, the memory 32 also serves as a working memory. In other words, the memory 32 temporally stores data in process of the processor 31, and the program executed by the processor 31.

The processor 31 executes the program stored in the memory 32 to control the image reading unit 12, the conveyance unit 19, the image forming section 20, and the fixing device 21. The processor 31 executes the program stored in the memory 32 to perform a process of generating a print job to form an image in a print medium P. For example, the processor 31 generates a print job based on an image acquired from an external device through, for example, the communication interface 13 or an image acquired by the image reading unit 12. The processor 31 stores the generated print job in the memory 32.

The print job includes image data indicating an image to be formed in the print medium P. The image data may be data for forming an image in one print medium. P, or may be data for forming an image in a plurality of print mediums P. Further, the print job includes information indicating whether the job is a color print or a monochrome print.

The display unit 15 includes a display which displays a screen according to a video signal which is input from a display control unit such as the system controller 14 or a graphic controller (not illustrated). For example, a screen for various settings of the image forming apparatus 1 is displayed in the display of the display unit 15.

The operation interface 16 is connected to an operation member (not illustrated). The operation interface 16 supplies an operation signal to the system controller 14 according to an operation of the operation member. The operation member is, for example, a touch sensor, a ten key, a power key, a paper feed key, various types of function keys, or a keyboard. The touch sensor acquires information indicating a position which is designated in a certain region. The touch sensor is configured as a touch panel which is integrated with the display unit 15, and thus inputs a signal indicating a touched position on the screen displayed in the display unit 15 to the system controller 14.

The plurality of paper trays 17 are cassettes which contain the print mediums P respectively. The paper tray 17 is configured to supply the print medium P from the outside of the housing 11. For example, the paper tray 17 is configured to be drawn from the housing 11.

The paper discharge tray 18 is a tray which supports the print medium P discharged from the image forming apparatus 1.

The conveyance unit 19 serves as a mechanism to convey the print medium P in the image forming apparatus 1. As illustrated in FIG. 1, the conveyance unit 19 includes a plurality of conveyance paths. For example, the conveyance unit 19 includes a feeding conveyance path 41 and a discharging conveyance path 42.

The feeding conveyance path 41 and the discharging conveyance path 42 are configured by a plurality of motors, a plurality of rollers, and a plurality of guides which are not illustrated. The plurality of motors rotate shafts based on the control of the system controller 14 so as to rotate rollers which are linked to the rotation of the shafts. The plurality of rollers move the print medium P by the rotation. The plurality of guides control a conveyance direction of the print medium P.

The feeding conveyance path 41 receives the print medium P from the paper tray 17, and supplies the received print medium P to the image forming section 20. The feeding conveyance path 41 includes pickup rollers 43 corresponding to each paper tray. Each pickup roller 43 feeds the print medium P of the paper tray 17 to the feeding conveyance path 41.

The discharging conveyance path 42 is a conveyance path through which the print medium P with an image formed is discharged from the housing 11. The print medium P discharged by the discharging conveyance path 42 is supported by the paper discharge tray 18.

Next, the image forming section 20 will be described.

The image forming section 20 is configured to form an image in the print medium P based on the control of the system controller 14. Specifically, the image forming section 20 forms an image in the print medium P based on the print job which is generated by the processor 31. The image forming section 20 includes a plurality of process units 51, a primary transfer belt 52, a secondary transfer opposing roller 53, a plurality of primary transfer rollers 54, a secondary transfer roller 55, and a sensor 56.

First, the configuration related to forming an image of the image forming section 20 will be described.

The process unit 51 is configured to form the toner image. For example, the plurality of process units 51 are provided for every toner type. For example, the plurality of process units 51 correspond to the color toners of Cyan, Magenta, Yellow, and Black. Further, the plurality of process units 51 have the same configuration except the filled developer, and thus the description will be given on one process unit 51.

The process unit 51 includes a photosensitive drum 57, an electric charger 58, a developing device 59, and an exposing device 60.

The photosensitive drum 57 is a photoconductor which includes a cylindrical drum and a photosensitive layer formed in the outer peripheral surface of the drum. The photosensitive drum 57 rotates at a constant speed by a drive mechanism (not illustrated).

The electric charger 58 evenly charges the surface of the photosensitive drum 57. For example, the electric charger 58 evenly charges the photosensitive drum 57 with a negative polarity using a charging roller. The charging roller rotates as the photosensitive drum 57 rotates in a state where a predetermined pressure is applied to the photosensitive drum 57.

The developing device 59 is a device which attaches the toner to the photosensitive drum 57. The developing device 59 includes a developer container, a developing sleeve, and a doctor blade.

The developer container is a container which stores a developer containing toner and carrier. The developer is filled from a toner cartridge. The developing sleeve rotates in the developer container so as to attach the developer to the surface. The doctor blade is a member which is disposed with a predetermined gap with respect to the developing sleeve. The doctor blade adjusts a thickness of the developer which is attached to the surface of the developing sleeve.

In the above configuration, if the light is emitted from the exposing device 60 (described below) to the surface of the photosensitive drum 57 charged by the electric charger 58, an electrostatic latent image is formed. If a developer layer formed in the surface of the developing sleeve abuts on the surface of the photosensitive drum 57, the toner contained in the developer is attached to the latent image formed in the surface of the photosensitive drum. With this configuration, the toner image is formed in the surface of the photosensitive drum 57.

Figure 2:
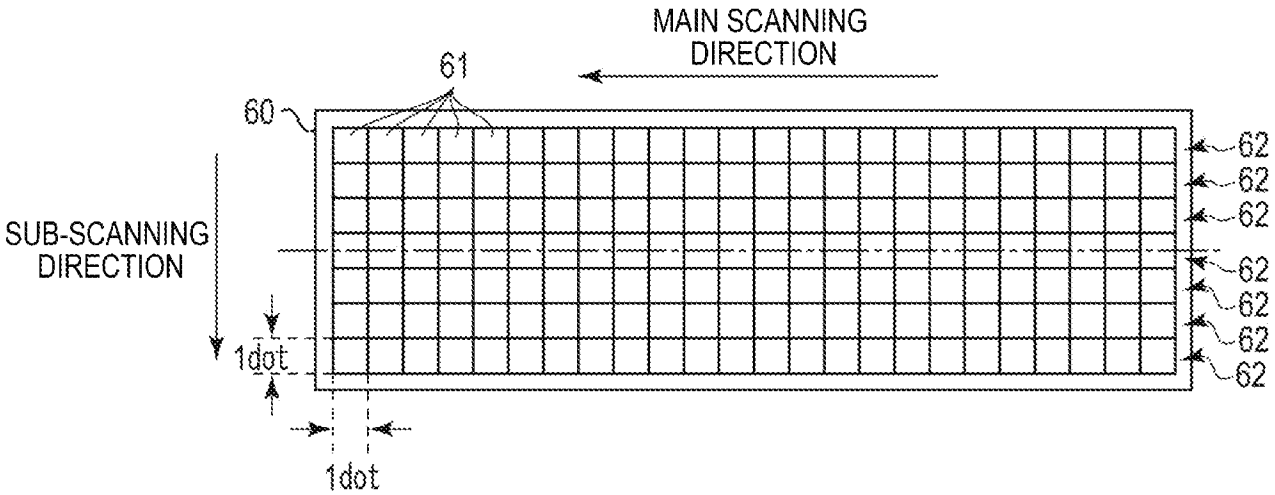
FIG. 2 is a diagram for describing an exemplary configuration of an exposing device of the image forming apparatus according to an embodiment.

Each of the plurality of exposing devices 60 is provided to correspond to the photosensitive drum 57. FIG. 2 is an explanatory diagram for describing the configuration of the exposing device 60. The exposing device 60 includes a light emitting element row 62 in which the plurality of light emitting elements 61 are arranged in the main scanning direction which is paralleled by the rotation shaft of the photosensitive drum 57. Further, the exposing device 60 includes a plurality of light emitting elements rows 62 in the sub-scanning direction which is paralleled by the conveyance direction of the primary transfer belt 52. The light emitting elements 61 each are a laser diode or a light emitting diode (LED). One light emitting element 61 is configured to emit light at one point on the photosensitive drum 57. In other words, one light emitting element 61 corresponds to one dot.

The exposing device 60 emits the light from the light emitting element 61 to the photosensitive drum 57 based on the control of the system controller 14 to form the latent image on the photosensitive drum 57. The exposing device 60 turns on any one of the plurality of light emitting elements 61 of the sub-scanning direction. In addition, the exposing device 60 turns on the light emitting elements 61 all over the region in the main scanning direction.

For example, the exposing device 60 emits the light from the plurality of light emitting elements 61 of one light emitting element row 62 to the photosensitive drum 57 to form one line of latent image on the photosensitive drum 57. In other words, the exposing device 60 turns on the light emitting elements 61 all over the region in the main scanning direction to form one line of latent image on the photosensitive drum 57. The exposing device 60 emits the light continuously to the rotating photosensitive drum 57 to form plural lines of latent image.

In addition, for example, the exposing device 60 selects the light emitting elements 61 in the sub-scanning direction all over the region for every dot in the main scanning direction based on the control of the system controller 14. The exposing device 60 turns on the selected light emitting elements 61 all over the region in the main scanning direction to form one line of latent image on the photosensitive drum 57. The exposing device 60 emits the light continuously to the rotating photosensitive drum 57 to form plural lines of latent image. In other words, the exposing device 60 emits the light on the photosensitive drum 57 while switching the light emitting element rows 62 in the sub-scanning direction based on the control of the system controller 14. With this configuration, the exposing device 60 can shift a light emitting position on the photosensitive drum 57 in the sub-scanning direction.

Next, the configuration related to the transferring of the image forming section 20 will be described.

Figure 3:
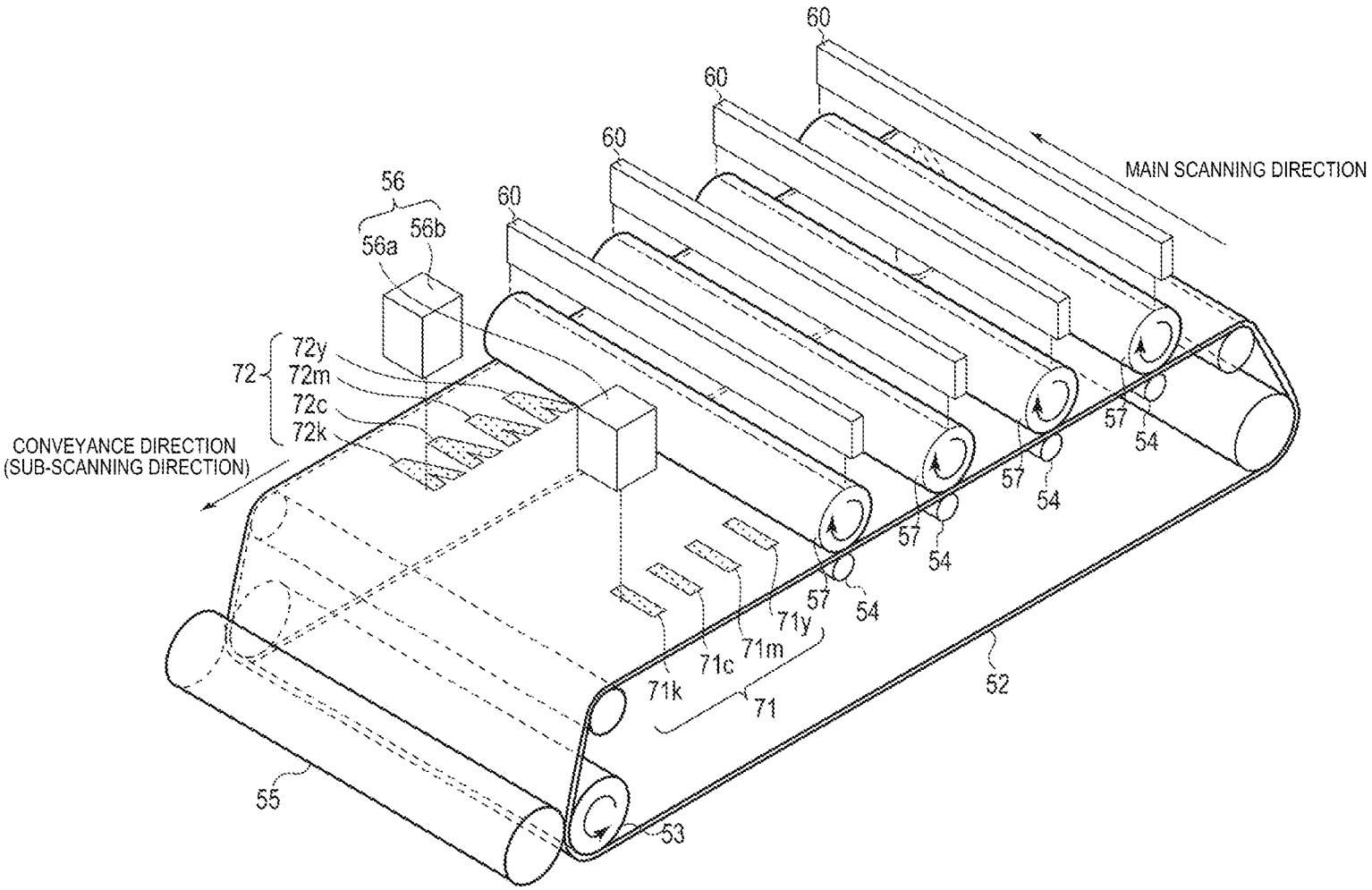
FIG. 3 is a diagram for describing an exemplary configuration around a process unit and a primary transfer belt of the image forming apparatus according to an embodiment.

FIG. 3 is an explanatory diagram for describing the configuration related to the transferring of the image forming section 20. The primary transfer belt 52 is an endless belt which is wound on the secondary transfer opposing roller 53 and a plurality of winding rollers. The primary transfer belt 52 is configured such that the inside surface (inner peripheral surface) thereof comes into contact with the secondary transfer opposing roller 53 and the plurality of winding rollers, and the outside surface (outer peripheral surface) faces the photosensitive drum 57 of the process unit 51.

The secondary transfer opposing roller 53 rotates by a motor (not illustrated). The secondary transfer opposing roller 53 rotates to convey the primary transfer belt 52 in a predetermined conveyance direction. The plurality of winding rollers are configured to freely rotate. The plurality of winding rollers rotate in accordance with the movement of the primary transfer belt 52 by the secondary transfer opposing roller 53.

The plurality of primary transfer rollers 54 are configured to bring the primary transfer belt 52 into contact with the photosensitive drum 57 of the process unit 51. The plurality of primary transfer rollers 54 are provided to correspond to the photosensitive drums 57 of the plurality of process units 51. Specifically, the plurality of primary transfer rollers 54 are provided at positions facing the corresponding photosensitive drums 57 of the process units 51 with the primary transfer belt 52 interposed therebetween. The primary transfer roller 54 comes into contact with the inner peripheral surface of the primary transfer belt 52, and shifts the primary transfer belt 52 toward the photosensitive drum 57. With this configuration, the primary transfer roller 54 brings the outer peripheral surface of the primary transfer belt 52 into contact with the photosensitive drum 57.

The secondary transfer roller 55 is provided at a position facing the primary transfer belt 52. The secondary transfer roller 55 comes into contact with the outer peripheral surface of the primary transfer belt 52, and applies pressure. With this configuration, there is formed a transfer nip portion where the secondary transfer roller 55 and the outer peripheral surface of the primary transfer belt 52 come into tight contact. If the print medium P passes through the transfer nip portion, the secondary transfer roller 55 presses the print medium P passing through the transfer nip portion toward the outer peripheral surface of the primary transfer belt 52.

The secondary transfer roller 55 and the secondary transfer opposing roller 53 rotate to convey the print medium P in a state where the print medium P supplied from the feeding conveyance path 41 is interposed. With this configuration, the print medium P passes through the transfer nip portion.

In the above configuration, if the outer peripheral surface of the primary transfer belt 52 comes into contact with the photosensitive drum, the toner image formed in the surface of the photosensitive drum is transferred to the outer peripheral surface of the primary transfer belt 52. As illustrated in FIG. 3, if the image forming section 20 includes the plurality of process units 51, the primary transfer belt 52 receives the toner images from the photosensitive drums 57 of the plurality of process units 51. The toner image transferred to the outer peripheral surface of the primary transfer belt 52 is conveyed by the primary transfer belt 52 up to the transfer nip portion where the secondary transfer roller 55 and the outer peripheral surface of the primary transfer belt 52 are brought into tight contact. If there is a print medium P in the transfer nip portion, the toner image transferred to the outer peripheral surface of the primary transfer belt 52 is transferred to the print medium P in the transfer nip portion. In other words, the primary transfer belt 52 serves as a transferring member which receives the toner image in the outer peripheral surface from the photosensitive drum 57, and transfers the toner image to the print medium P passing through the transfer nip portion.

The sensor 56 detects the toner images transferred from the photosensitive drums 57 of the plurality of process units 51 to the outer peripheral surface of the primary transfer belt 52 (transferring member). As illustrated in FIG. 3, the sensor 56 includes a first sensor 56*a* and a second sensor 56*b* which detect the toner image at different positions in the main scanning direction.

The first sensor 56*a* and the second sensor 56*b* detect a concentration of the toner image by detecting a reflected light on the outer peripheral surface of the primary transfer belt 52 (transferring member). The first sensor 56*a* and the second sensor 56*b* detect a reflected light at one detection position on the outer peripheral surface of the primary transfer belt 52. For example, the first sensor 56*a* and the second sensor 56*b* are disposed such that a line connecting a detection position of the first sensor 56*a* and a detection position of the second sensor 56*b* is paralleled by the sub-scanning direction.

The first sensor 56*a* is disposed at a position where at least a first resist pattern 71 (described below) can be detected. In addition, the second sensor 56*b* is disposed at a position where at least a second resist pattern 72 (described below) can be detected. For example, the first sensor 56*a* is disposed at a position near the front side of the image forming apparatus 1 where the first resist pattern 71 (described below) can be detected. In addition, for example, the second sensor 56*b* is disposed at a position near the rear side of the image forming apparatus 1 where the second resist pattern 72 (described below) can be detected.

Next, the configuration related to the fixing of the image forming apparatus 1 will be described.

The fixing device 21 fixes the toner image to the print medium P where the toner image is formed. The fixing device 21 operates based on the control of the system controller 14. The fixing device 21 includes a heating member which applies heat to the print medium P, and a pressing member which applies pressure to the print medium P. For example, the heating member of the fixing device 21 is, for example, a heating roller 81.

The heating roller 81 is a fixing rotation body which rotates by a motor (not illustrated). The heating roller 81 includes a core formed of a hollow metal, and an elastic layer which is formed on the outer periphery of the core. The heating roller 81 is heated at a high temperature by a heater (not illustrated) which is disposed inside the hollow core. The heater is, for example, a halogen heater. In addition, the heater may be an induction heater (IH) which heats the core by electromagnetic induction.

The pressing member is, for example, a press roller 82. The press roller 82 is provided at a position facing the heating roller 81. The press roller 82 includes a metal core having a predetermined outer diameter, and an elastic layer which is formed on the outer periphery of the core. The press roller 82 applies pressure to the heating roller 81 by a stress applied from a tension member (not illustrated). Since the pressure is applied from the press roller 82 to the heating roller 81, a nip portion (fixing nip portion) is formed where the press roller 82 and the heating roller 81 come into tight contact. The press roller 82 rotates by a motor (not illustrated). The press roller 82 rotates to move the print medium P which enters the fixing nip portion and to press the print medium P to the heating roller 81.

With the above configuration, the heating roller 81 and the press roller 82 apply heat and pressure to the print medium P which passes through the fixing nip portion. With this configuration, the toner image is fixed to the print medium P passed through the fixing nip portion. The print medium P passed through the fixing nip portion is introduced to the discharging conveyance path 42, and discharged to the outside of the housing 11.

Next, an example of the operation of the image forming apparatus 1 will be described.

The processor 31 of the system controller 14 performs an image stabilization process at a predetermined timing. For example, the processor 31 performs the image stabilization process if the image forming apparatus 1 is switched from a sleep state to a ready state, or if the color print is performed.

Figure 4:
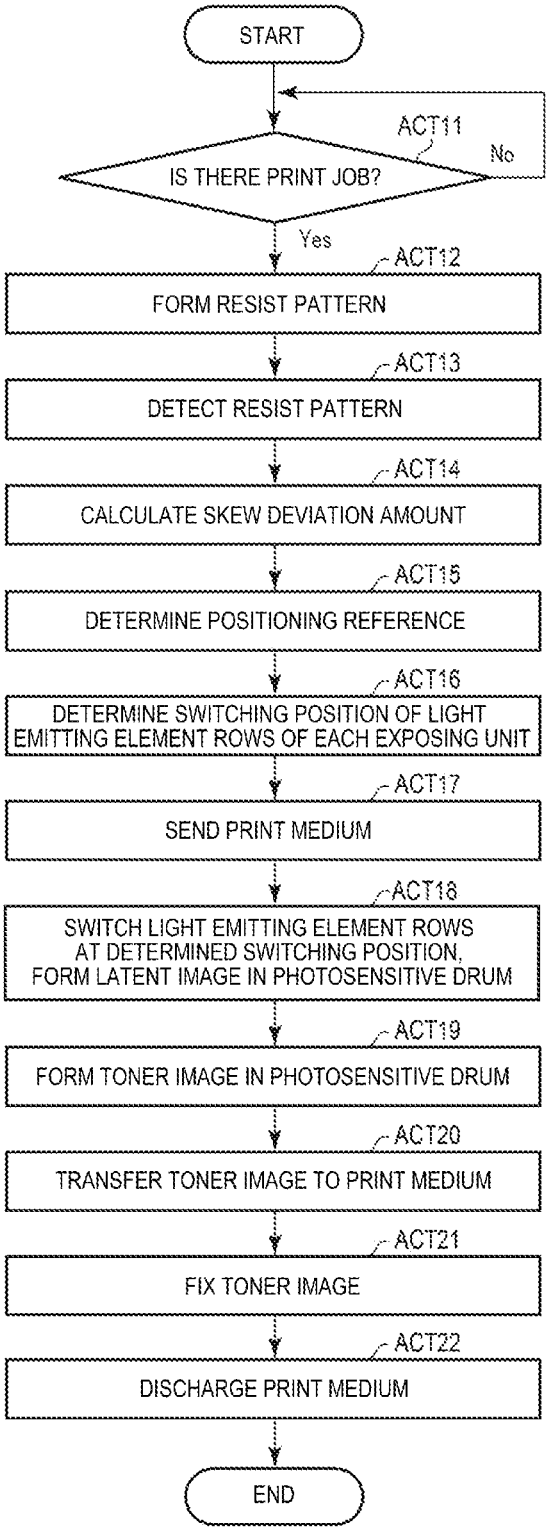
FIG. 4 is a diagram for describing an exemplary operation of the image forming apparatus according to an embodiment.

FIG. 4 is a flowchart for describing an operation of the image forming apparatus 1 if the image stabilization process is performed before the color print is performed.

The processor 31 determines whether there is a print job designated with the color print at a predetermined timing (ACT 11). The processor 31 keeps the determination of ACT 11 until the print job is generated. The processor 31 causes a resist pattern to be formed if it is determined in ACT 11 that there is a print job designated with the color print (ACT 11, YES). For example, the processor 31 controls the plurality of process units 51 such that the first resist pattern 71 and the second resist pattern 72 as illustrated in FIG. 3 are formed on the primary transfer belt 52 (ACT 12). For example, the processor 31 controls the plurality of process units 51 such that the first resist pattern 71 and the second resist pattern 72 are formed on the primary transfer belt 52 using the light emitting element row 62 disposed at the same position in the sub-scanning direction among the plurality of light emitting element rows 62 of each exposing device 60. Specifically, the processor 31 controls each process unit 51 to perform exposure to the photosensitive drum 57 by the light emitting element row 62 positioned at the center in the sub-scanning direction among the plurality of light emitting element rows 62. In addition, the processor 31 controls each process unit 51 to start to form the first resist pattern 71 and the second resist pattern 72 at the same time (that is, by the same line).

The first resist pattern 71 is a pattern which contains a plurality of toner images formed by each color of toner at a predetermined concentration. The first resist pattern 71 is formed to pass through at least a detection position of the first sensor 56*a*. In other words, the first resist pattern 71 is formed at a position near the front side of the image forming apparatus 1 on the primary transfer belt 52.

The first resist pattern 71 includes a toner image 71*k* formed by Black toner, a toner image 71*c* formed by Cyan toner, a toner image 71*m* formed by Magenta toner, and a toner image 71*y* formed by Yellow toner. The toner image

71*k* is a toner image which is formed by the process unit 51 corresponding to the Black toner. The toner image 71*c* is a toner image which is formed by the processing unit 51 corresponding to the Cyan toner. The toner image 71*m* is a toner image which is formed by the processing unit 51 corresponding to the Magenta toner. The toner image 71*y* is a toner image which is formed by the process unit 51 corresponding to the Yellow toner.

The first resist pattern 71 is formed on the primary transfer belt 52 such that the toner image 71*k*, the toner image 71*c*, the toner image 71*m*, and the toner image 71*y* are formed in this order with a predetermined gap in the sub-scanning direction. For example, the processor 31 controls the respective process units 51 to form the toner image 71*k*, the toner image 71*c*, the toner image 71*m*, and the toner image 71*y* at the same time. In this case, a gap between the toner image 71*k*, the toner image 71*c*, the toner image 71*m*, and the toner image 71*y* corresponds to a gap on the front side of the image forming apparatus 1 at a position where the toner image is formed on the primary transfer belt 52 by each process unit 51.

The second resist pattern 72 is a pattern which contains a plurality of toner images formed by each color of toner at a predetermined concentration. The second resist pattern 72 is formed to pass through at least a detection position of the second sensor 56*b*. In other words, the second resist pattern 72 is formed at a position near the rear side of the image forming apparatus 1 on the primary transfer belt 52.

The second resist pattern 72 includes a toner image 72*k* formed by Black toner, a toner image 72*c* formed by Cyan toner, a toner image 72*m* formed by Magenta toner, and a toner image 72*y* formed by Yellow toner. The toner image 72*k* is a toner image which is formed by the process unit 51 corresponding to the Black toner. The toner image 72*c* is a toner image which is formed by the processing unit 51 corresponding to the Cyan toner. The toner image 72*m* is a toner image which is formed by the processing unit 51 corresponding to the Magenta toner. The toner image 72*y* is a toner image which is formed by the process unit 51 corresponding to the Yellow toner.

The second resist pattern 72 is formed on the primary transfer belt 52 such that the toner image 72*k*, the toner image 72*c*, the toner image 72*m*, and the toner image 72*y* are formed in this order with a predetermined gap in the sub-scanning direction. For example, the processor 31 controls the respective process units 51 to form the toner image 72*k*, the toner image 72*c*, the toner image 72*m*, and the toner image 72*y* at the same time. In this case, a gap between the toner image 72*k*, the toner image 72*c*, the toner image 72*m*, and the toner image 72*y* corresponds to a gap on the rear side of the image forming apparatus 1 at a position where the toner image is formed on the primary transfer belt 52 by each process unit 51.

The processor 31 causes the sensor 56 to detect the resist pattern (ACT 13). In other words, the processor 31 controls the sensor 56 such that the first sensor 56*a* detects the first resist pattern 71, and the second sensor 56*b* detects the second resist pattern 72.

The processor 31 calculates the skew deviation amount of each process unit 51 based on the detection result of the first resist pattern 71 by the first sensor 56*a* and the detection result of the second resist pattern 72 by the second sensor 56*b* (ACT 14).

The skew deviation amount is information indicating a deviation between the process units 51. The skew deviation amount is information indicating a deviation in position of the toner images formed on the primary transfer belt 52 by the respective process units 51 based on certain image data. More specifically, the skew deviation amount is a difference between a slope of one line of toner image formed on the primary transfer belt 52 (transferring member) by any process unit 51 and a slope of one line of toner image formed by another process unit 51. The skew deviation amount is caused by a tolerance of various configurations of the plurality of process units 51 and an error occurring when being assembled. Further, hereinbelow, a slope of one line of toner image formed by the process unit 51 is simply called a slope of the process unit 51. If there is a skew deviation amount (that is, if there is a difference in the slope of the process unit 51), even if the toner images are formed on the primary transfer belt 52 by the respective process unit 51 based on the same image data, the positions of the formed toner images are not matched, and thus an image quality is degraded.

Figure 5:
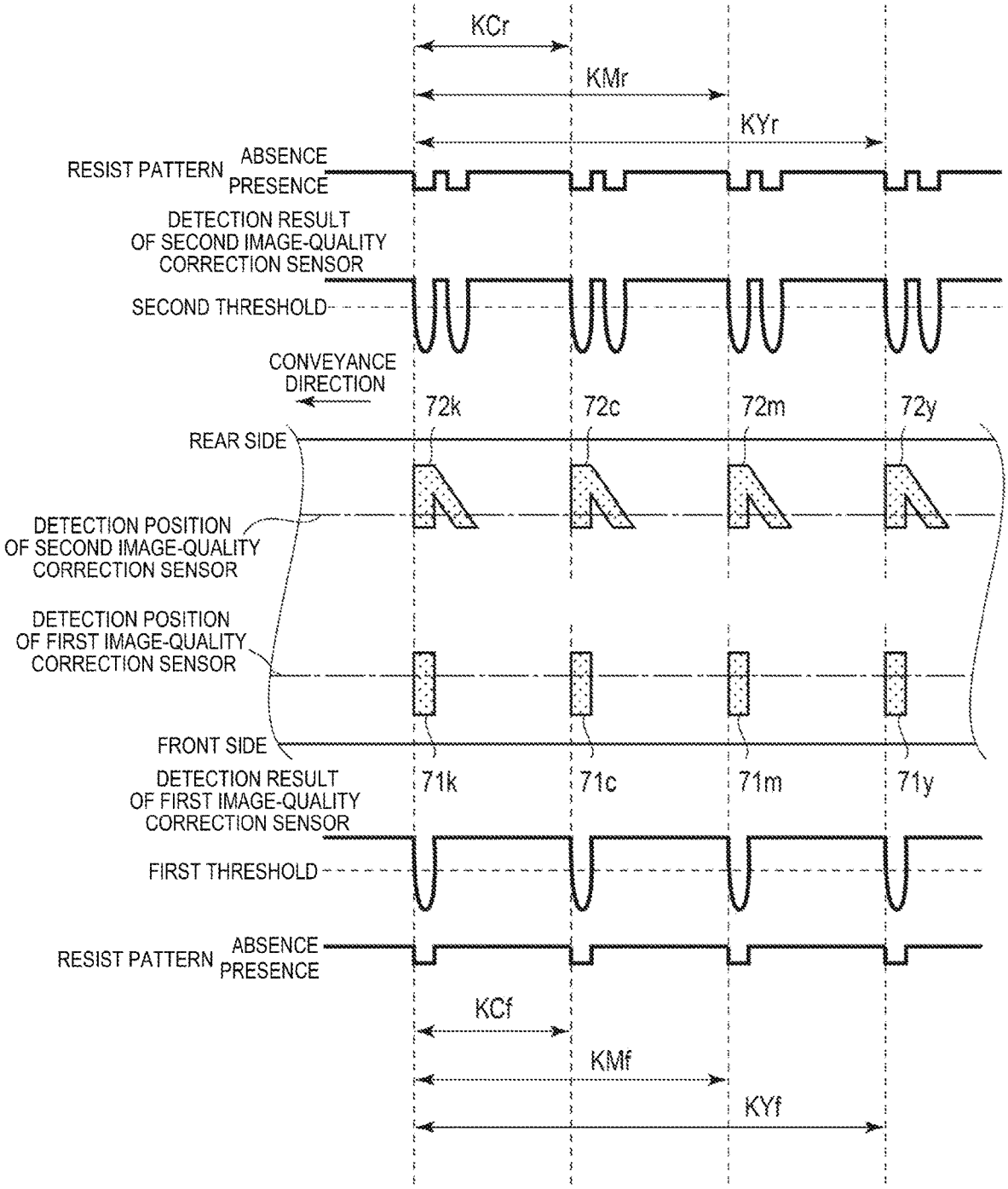
FIG. 5 is a diagram for describing an exemplary operation of the image forming apparatus according to an embodiment.

FIG. 5 is an explanatory diagram for describing the detection results of the first sensor 56*a* and the second sensor 56*b*. The horizontal axis represents timing when the toner image on the primary transfer belt 52 passes through the detection position of the sensor 56. First, the detection result of the first sensor 56*a* will be described.

As illustrated in FIG. 5, the processor 31 compares the detection result of the first sensor 56*a* with a predetermined first threshold. The processor 31 determines that the toner image exist at the detection position of the first sensor 56*a* if the detection result of the first sensor 56*a* is equal to or less than the first threshold. Since the order of the toner image 71*k*, the toner image 71*c*, the toner image 71*m*, and the toner image 71*y* in the first resist pattern 71 is already determined, the processor 31 can recognize timing when the toner image 71*k*, the toner image 71*c*, the toner image 71*m*, and the toner image 71*y* reach the detection position of the first sensor 56*a*.

Further, the processor 31 calculates each gap between the toner images. First, the processor 31 calculates a gap KCf on the front side between the toner image 71*k* and the toner image 71*c* based on timing when the toner image 71*k* and the toner image 71*c* each reach the detection position of the first sensor 56*a*. In addition, the processor 31 calculates a gap KMf on the front side between the toner image 71*k* and the toner image 71*m* based on timing when the toner image 71*k* and the toner image 71*m* each reach the detection position of the first sensor 56*a*. In addition, the processor 31 calculates a gap KYf on the front side between the toner image 71*k* and the toner image 71*y* based on timing when the toner image 71*k* and the toner image 71*y* each reach the detection position of the first sensor 56*a*.

Next, the detection result of the second sensor 56*b* will be described. As illustrated in FIG. 5, the processor 31 compares the detection result of the second sensor 56*b* with a predetermined second threshold. The processor 31 determines that the toner image exist at the detection position of the second sensor 56*b* if the detection result of the second sensor 56*b* is equal to or less than the second threshold. Since the order of the toner image 72*k*, the toner image 72*c*, the toner image 72*m*, and the toner image 72*y* in the second resist pattern 72 is already determined, the processor 31 can recognize timing when the toner image 72*k*, the toner image 72*c*, the toner image 72*m*, and the toner image 72*y* reach the detection position of the second sensor 56*b*.

Further, the processor 31 calculates each gap between the toner images. First, the processor 31 calculates a gap KCr on the rear side between the toner image 72*k* and the toner image 72*c* based on timing when the toner image 72*k* and the toner image 72*c* each reach the detection position of the second sensor 56*b*. In addition, the processor 31 calculates a gap KMr on the rear side between the toner image 72*k* and the toner image 72*m* based on timing when the toner image 72*k* and the toner image 72*m* each reach the detection position of the second sensor 56*b*. In addition, the processor 31 calculates a gap KYr on the rear side between the toner image 72*k* and the toner image 72*y* based on timing when the toner image 72*k* and the toner image 72*y* each reach the detection position of the first sensor 56*b*.

Next, the processor 31 calculates KCf−KCr which is a difference between the gap KCf on the front side between the toner image 71*k* and the toner image 71*c*, and the gap KCr on the rear side between the toner image 72*k* and the toner image 72*c*. The difference KCf−KCr is a skew deviation amount indicating a difference between the slope of the process unit 51 which forms the toner image 71*c* and the toner image 72*c* and the slope of the process unit 51 which forms the toner image 71*k* and the toner image 72*k*.

In addition, the processor 31 calculates KMf−KMr which is a difference between the gap KMf on the front side between the toner image 71*k* and the toner image 71*m*, and the slope on the rear side between the toner image 72*k* and the toner image 72*m*. The difference KMf−KMr is a skew deviation amount indicating a difference between the slope of the process unit 51 which forms the toner image 71*m* and the toner image 72*m* and the slope of the process unit 51 which forms the toner image 71*k* and the toner image 72*k*.

In addition, the processor 31 calculates KYf−KYr which is a difference between the gap KYf on the front side between the toner image 71*k* and the toner image 71*y* and the gap KYr on the rear side between the toner image 72*k* and the toner image 72*y*. The difference KYf−KYr is a skew deviation amount indicating a difference between the slope of the process unit 51 which forms the toner image 71Y and the toner image 72*y* and the slope of the process unit 51 which forms the toner image 71*k* and the toner image 72*k*. Further, the process unit 51 which forms the toner image 71*k* and the toner image 72*k* is used as a reference for calculating the skew deviation amount, and thus performs the following calculation assuming that the skew deviation amount is "0".

Next, the processor 31 determines a positioning reference (ACT 15). The positioning reference is a reference of the slop of the process unit 51 which is used when the toner image is formed on the primary transfer belt 52 by each process unit 51.

First, the processor 31 calculates the central tendency of each skew deviation amount which is calculated in ACT 14. The central tendency indicates a bias of the distribution of a plurality of skew deviation amounts. The central tendency is, for example, an average value. In addition, the central tendency may be a center value or a most frequent value. Further, in this embodiment, the central tendency is assumed as the average value. In other words, the processor 31 calculates the average value of the skew deviation amounts calculated in ACT 14.

The processor 31 determines the positioning reference based on the central tendency. For example, the processor 31 determines the slope of the process unit 51 having the skew deviation amount at which a difference from the average value of the skew deviation amounts becomes smallest as the positioning reference.

Next, the processor 31 determines a switching position of the light emitting element row 62 of each exposing device (ACT 16). In other words, the processor 31 determines whether to perform the control of turning on and off each region corresponding to the light emitting elements 61 aligned in the main scanning direction in the exposing device 60 by any light emitting element 61 among the light emitting elements 61 arranged in the sub-scanning direction.

Figure 6:
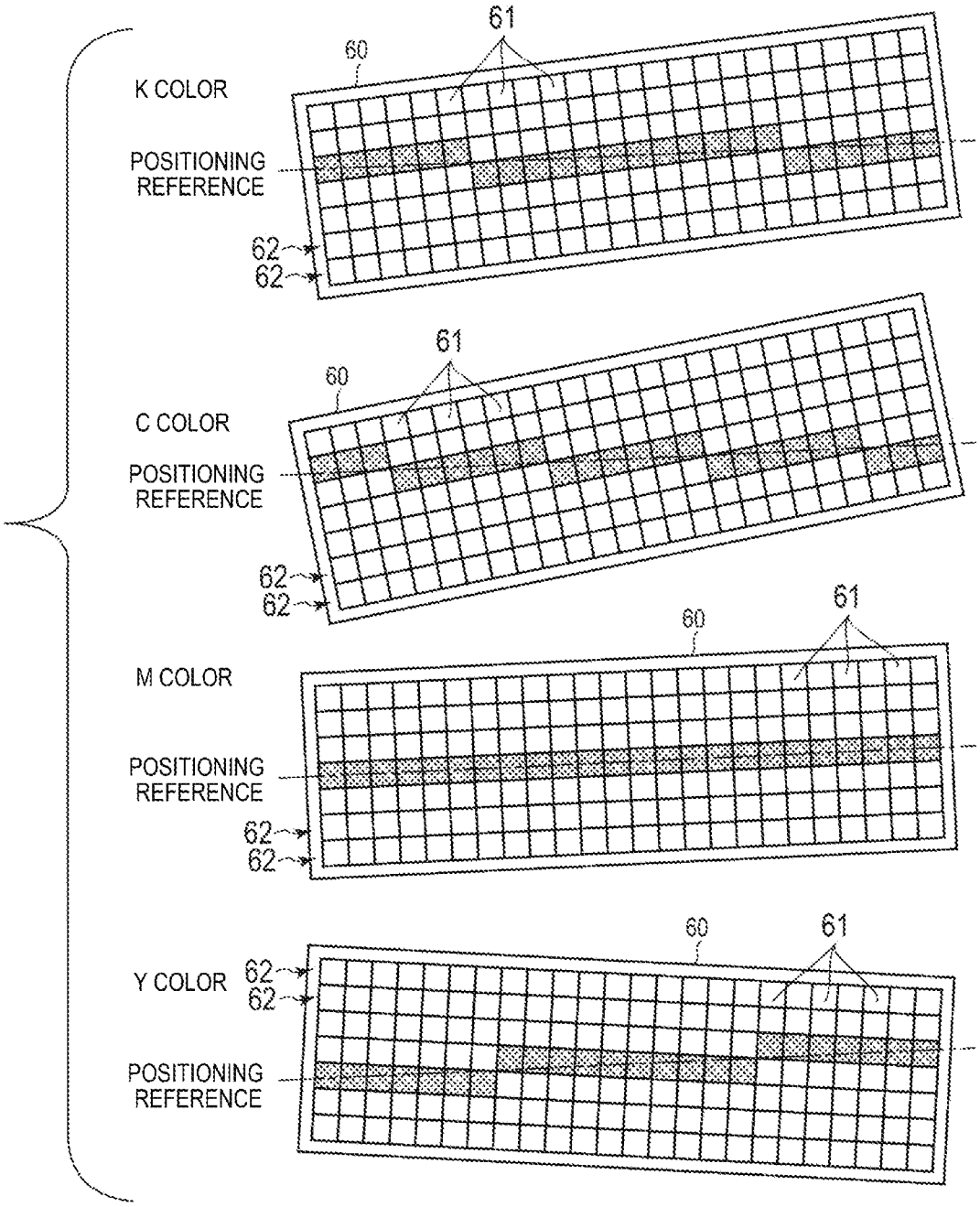
FIG. 6 is a diagram for describing an exemplary operation of the image forming apparatus according to an embodiment.

FIG. 6 is an explanatory diagram for describing the control of turning on and off the light emitting element 61 of the exposing device 60. In this example, the description will be given on an assumption that the Magenta toner image is formed by the process unit 51 having a skew deviation amount at which a difference from the average value of the skew deviation amounts becomes smallest. In other words, the positioning reference is a slope of the process unit 51 which forms the Magenta toner image.

The processor 31 controls turning on and off the light emitting element 61 of the exposing device 60 of each process unit 51 based on the positioning reference and the skew deviation amount of each process unit 51. For example, the processor 31 determines a position of the lighting light emitting element 61 for every region corresponding to the light emitting elements 61 aligned in the main scanning direction in the exposing device 60 based on the positioning reference and the skew deviation amount of each process unit 51.

Specifically, as illustrated in FIG. 6, the processor 31 overlaps a line paralleled by the positioning reference on the surface where the light emitting elements 61 of the exposing device 60 are arranged. The processor 31 performs setting such that the light emitting elements 61 at the positions overlapping with the line paralleled by the positioning reference are turned on. In other words, the processor 31 sets a position in the main scanning direction to switch the light emitting element row 62. The processor 31 stores the setting to the memory 32 for example. In addition, the processor 31 may be configured to store an offset value to the memory 32 which indicates a position of the light emitting element 61 to be turned on for every row of the light emitting elements 61 aligned in the sub-scanning direction. Finally, the image stabilization process is completed.

In the example of FIG. 6, the light emitting element 61 to be turned on is hatched. In the example of FIG. 6, the switching of the light emitting element row 62 is not performed in the process unit 51 for the Magenta toner image determined as the positioning reference. In addition, there is set such that the switching of the light emitting element row 62 is performed two times in the process unit 51 for the Black toner image, the switching of the light emitting element row 62 is performed four times in the process unit 51 for the Cyan toner image, and the switching of the light emitting element row 62 is performed two times in the process unit 51 for the Yellow toner image. In this way, with the control of turning on and off the light emitting elements 61, the slopes of one line of toner images to be formed on the primary transfer belt 52 become almost equal by the process units 51.

Next, the processor 31 controls the conveyance unit 19 such that the print medium P is sent from the paper tray 17 to the feeding conveyance path 41 in order to perform the color print (ACT 17).

The processor 31 controls the exposing device 60 such that the light emitting element row 62 is switched based on the setting of the switching position of the light emitting element row 62 of the exposing device 60 determined in ACT 16 to turn on the light emitting elements 61, and the electrostatic latent image is formed in the charged photosensitive drum 57 (ACT 18). In other words, the processor 31 causes the light emitting elements 61 hatched in FIG. 6 to emit light to the photosensitive drum 57.

The processor 31 causes the developing device 59 to attach the toner to the electrostatic latent image of the photosensitive drum 57 so as to form the toner image corresponding to the image data of the print job in the photosensitive drum 57 (ACT 19).

The processor 31 controls the image forming section 20 to transfer the toner image formed in the photosensitive drum to the print medium P (ACT 20). Specifically, the processor 31 rotates the secondary transfer opposing roller 53 and the secondary transfer roller 55 to move the outer peripheral surface of the primary transfer belt 52 in the state of coming into contact with the photosensitive drum 57. If the outer peripheral surface of the primary transfer belt 52 comes into contact with the photosensitive drum 57, the toner image formed in the surface of the photosensitive drum 57 is transferred to the outer peripheral surface of the primary transfer belt 52. The toner image transferred to the outer peripheral surface of the primary transfer belt 52 is moved by the primary transfer belt 52 up to the transfer nip portion where the secondary transfer roller 55 and the outer peripheral surface of the primary transfer belt 52 comes into tight contact. The processor 31 causes the print medium P to pass through the transfer nip portion in a state that the toner image transferred to the primary transfer belt 52 comes into contact with the print medium P supplied from the feeding conveyance path 41. With this configuration, the toner image of the outer peripheral surface of the primary transfer belt 52 is transferred to the print medium P which passes through the transfer nip portion.

The processor 31 controls the fixing device 21 to fix the toner image transferred to the print medium P onto the print medium P (ACT 21). Specifically, the processor 31 heats the heating roller 81 using a heater and rotates the heating roller 81 and the press roller 82. With this configuration, the heating roller 81 and the press roller 82 pass the print medium P through the fixing nip portion while applying heat and pressure. As a result, the toner image is fixed to the print medium P passed through the fixing nip portion.

The processor 31 controls the conveyance unit 19 to discharge the print medium P passed through the fixing nip portion toward the paper discharge tray 18 by the discharging conveyance path 42 (ACT 22), and ends the color print.

As described above, the image forming apparatus 1 includes the plurality of process units 51. The process unit 51 includes the photosensitive drum 57, the electric charger 58, the developing device 59, and the exposing device 60 which includes the plurality of light emitting element rows 62 in the sub-scanning direction, each of which includes the plurality of light emitting elements 61 arranged in the main scanning direction. The exposing device 60 emits the light onto the photosensitive drum 57 while switching the light emitting element rows 62. In addition, the image forming apparatus 1 includes the primary transfer belt 52 which receives the toner image from the photosensitive drum 57 and transfers the toner image to the print medium P, the sensor 56 which detects the toner image on the primary transfer belt 52, and the processor 31. The processor 31 calculates the skew deviation amount of each process unit 51 based on the detection result of the sensor 56. The processor 31 controls turning on and off the light emitting elements 61 of each exposing device 60 based on the central tendency of the calculated skew deviation amount and the skew deviation amount of each process unit 51.

In this way, the processor 31 does not fix the process units to be matched in slope to any one thereof, but select the process unit 51 to be matched in slope based on the central tendency which is a bias of the skew deviation amount of each process unit 51. With this configuration, it is possible to prevent that a difference between toner images caused by switching the light emitting element rows 62 is significantly large in some color. With this configuration, the image forming apparatus 1 can keep the image quality while correcting the slope between the process units 51.

In addition, the processor 31 calculates the difference between the slope of one line of toner image formed on the primary transfer belt 52 by any one of the process units 51 and the slope of one line of toner image formed by another process unit 51 as the skew deviation amount. Further, the processor 31 selects the light emitting element 61 to be turned on in the sub-scanning direction based on the central tendency and the skew deviation amount of each process unit 51. With this configuration, the image forming apparatus 1 can appropriately correct the slope between the process units 51.

In addition, the processor 31 calculates the average value of the skew deviation amounts as the central tendency, and determines the slope of the process unit 51 having the skew deviation amount at which a difference from the average value of the skew deviation amounts of each process unit 51 becomes smallest as the positioning reference. Further, the processor 31 controls turning on and off the light emitting element 61 of each exposing device 60 based on the positioning reference and the skew deviation amount of each process unit 51. With this configuration, the image forming apparatus 1 can uniformalize the number of differences of the toner images which are generated by switching the light emitting element row 62.

Further, the description has been given about that the processor 31 calculates the average value of the skew deviation amounts as the central tendency, and the slope of the process unit 51 having the skew deviation amount at which a difference from the average value of the skew deviation amounts of each process unit 51 becomes smallest is determined as the positioning reference, but the embodiment is not limited to the configuration. The processor 31 may be configured to determine the average value of the skew deviation amounts of each process unit 51 as the positioning reference. In other words, the processor 31 may be configured to determine the central tendency itself of the skew deviation amounts of each process unit 51 as the positioning reference. Even in this case, the processor 31 controls turning on and off the light emitting element 61 of each exposing device 60 based on the positioning reference and the skew deviation amount of each process unit 51. With this configuration, the image forming apparatus 1 can uniformalize the number of differences of the toner images which are generated by switching the light emitting element row 62.

In addition, the processor 31 may be configured to assign a coefficient to each process unit 51 when the central tendency is calculated. For example, the processor 31 multiplies the predetermined coefficient for each process unit 51 to the skew deviation amount of each process unit 51. The processor 31 may be configured to calculate the central tendency based on the multiplication result. In other words, the processor 31 calculates the multiplication result obtained by multiplying the coefficient to the skew deviation amount for each process unit 51, and calculates the central tendency such as the average value, the center value, or the most frequent value of the calculated multiplication results. With such a configuration, it is possible to attach more importance to the slope of a specific process unit 51.

A difference in the toner images caused by the switching of the light emitting element row 62 may be unnoticeable depending on the toner color. For example, a difference of the Black toner is easily noticeable compared to the other toner colors. In addition, a difference of the Yellow toner is unnoticeable compared to the other toner colors. Therefore, the coefficient of the process unit 51 for the Black toner color may be set to a value higher than the other coefficients, and the coefficient of the process unit 51 for the Yellow toner color may be set to a value lower than the other coefficients. In other words, the coefficient to be multiplied to the skew deviation amount of each process unit 51 may be determined based on the toner color of the process unit 51. With such a configuration, it is possible to reduce the number of differences of the toner image of the color making a difference easily noticeable to be low instead of increasing the number of differences of the toner image of the color making a difference hardly noticeable. With this configuration, it is possible to prevent that the image quality is degraded.

Further, the coefficient is set based on information input through the operation interface 16 or the communication interface 13 for example, and stored in the memory 32. In addition, the coefficient may be set based on the other factors instead of being set according to the toner color as described above. In other words, the coefficient may be arbitrarily set for each process unit 51, and may be set to any value.

Further, in the above embodiment, the image forming apparatus 1 has been described as being configured to perform the image stabilization process at timing before the color print is performed, but the embodiment is not limited thereto. The image forming apparatus 1 may be configured to perform the image stabilization process when being activated, when the state is restored from the sleep state to the ready state, or at any other timing.

Further, the functions described in the embodiments are not limited to the hardware configuration, and may be realized by a software program which, when executed by a computer, causes the computer to perform the respective functions. In addition, the functions may be configured by selecting any one of appropriate software and hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a plurality of process units including a photosensitive drum, an electric charger which charges the photosensitive drum, an exposing device which includes a plurality of light emitting element rows in a sub-scanning direction in which a plurality of light emitting elements are arranged in a main scanning direction, and configured to irradiate the photosensitive drum to form a latent image while switching the light emitting element rows, and a developing device which attaches toner to the latent image of the photosensitive drum to form a toner image;

a transferring member configured to receive the toner image from the photosensitive drum of each process unit, and transfer the toner image to a print medium;

a sensor configured to detect the toner image transferred from the photosensitive drum of each process unit to the transferring member; and a processor configured to calculate a skew deviation amount of the process unit based on a detection result of the sensor, and control turning on and off one or more light emitting elements of the light emitting element rows of the exposing device based on a central tendency of the calculated skew deviation amount and the skew deviation amount of the process unit, wherein the skew deviation amount is a difference between a slope of one line of the toner image formed on the transferring member by any one of the process units and a slope of one line of the toner image formed by another one of the process units.

2. The apparatus according to claim 1, wherein the processor selects the light emitting element to be turned on in the sub-scanning direction based on the central tendency and the skew deviation amount of the process unit.

3. The apparatus according to claim 2, wherein the central tendency is an average value, and the processor is configured to determine a slope of the process unit of the skew deviation amount at which a difference from an average value of the skew deviation amounts of the process unit becomes smallest as a positioning reference, and control the light emitting element to be turned on of the exposing device based on the positioning reference and the skew deviation amount of the process unit.

4. The apparatus according to claim 2, wherein the central tendency is an average value, and the processor is configured to determine an average value of the skew deviation amount of the process unit as a positioning reference, and control the light emitting element to be turned on of the exposing device based on the positioning reference and the skew deviation amount of the process unit.

5. The apparatus according to claim 2, wherein the processor assigns a coefficient to each of the process units for the skew deviation amount of the process unit, and uses the coefficient to calculate the central tendency.

6. The apparatus according to claim 5, wherein the processor determines the coefficient to be assigned to the process unit based on a toner color of the process unit.

7. The apparatus according to claim 6, wherein the processor sets the coefficient of the process unit of which the toner color is black to be a value higher than other coefficients.

8. The apparatus according to claim 6, wherein the processor sets the coefficient of the process unit of which the toner color is yellow to be a value lower than other coefficients.

9. A control method of an image forming apparatus, wherein the image forming apparatus includes a plurality of process units including a photosensitive drum, an electric charger which charges the photosensitive drum, an exposing device which includes a plurality of light emitting element rows in a sub-scanning direction in which a plurality of light emitting elements are arranged in a main scanning direction, and irradiates the photosensitive drum to form a latent image while switching the light emitting element rows, and a developing device which attaches toner to the latent image of the photosensitive drum to form a toner image, receiving the toner image from the photosensitive drum of each process unit, and transferring the toner image to a print medium;

detecting the toner image transferred from the photosensitive drum of each process unit to the transferring member; and calculating a skew deviation amount of the process unit based on a detection result, and controlling turning on and off one or more light emitting elements of the exposing device based on a central tendency of the calculated skew deviation amount and the skew deviation amount of the process unit, wherein the skew deviation amount is a difference between a slope of one line of toner image formed on the transferring member by any one of the process units and a slope of one line of the toner image formed by another one of the process units.

10. The method according to claim 9, further comprising:

selecting the light emitting element to be turned on in the sub-scanning direction based on the central tendency and the skew deviation amount of the process unit.

11. The method according to claim 10, wherein the central tendency is an average value, and further comprising:

determining a slope of the process unit of the skew deviation amount at which a difference from an average value of the skew deviation amounts of the process unit becomes smallest as a positioning reference, and controlling the light emitting element to be turned on of the exposing device based on the positioning reference and the skew deviation amount of the process unit.

12. The method according to claim 10, wherein the central tendency is an average value, and further comprising:

determining an average value of the skew deviation amount of the process unit as a positioning reference, and controlling the light emitting element to be turned on of the exposing device based on the positioning reference and the skew deviation amount of the process unit.

13. The method according to claim 10, further comprising:

assigning a coefficient to each of the process units for the skew deviation amount of the process unit, and using the coefficient to calculate the central tendency.

14. The method according to claim 13, further comprising:

determining the coefficient to be assigned to the process unit based on a toner color of the process unit.

15. The method according to claim 14, further comprising:

setting the coefficient of the process unit of which the toner color is black to be a value higher than other coefficients.

16. The method according to claim 14, further comprising:

setting the coefficient of the process unit of which the toner color is yellow to be a value lower than other coefficients.

* * * * *